United States Patent [19]

Friedel

[11] 4,255,685

[45] Mar. 10, 1981

[54] ROTATING ANODE FOR X-RAY TUBES

[75] Inventor: Rudolf Friedel, Kleinseebach, Fed. Rep. of Germany

[73] Assignee: Siemens Aktiengesellschaft, Berlin & Munich, Fed. Rep. of Germany

[21] Appl. No.: 54,410

[22] Filed: Jul. 3, 1979

[30] Foreign Application Priority Data

Aug. 1, 1978 [DE] Fed. Rep. of Germany ..... 2833751

[51] Int. Cl.[3] ..... H01J 35/08

[52] U.S. Cl. ..... 313/330; 313/55

[58] Field of Search ..... 313/330, 311, 55

[56] References Cited

U.S. PATENT DOCUMENTS

| | | | |
|---|---|---|---|
| 2,935,633 | 5/1960 | Peters | 313/330 X |
| 3,710,170 | 1/1973 | Friedel | 313/330 |
| 3,751,702 | 8/1973 | Dietz | 313/330 |
| 3,819,971 | 6/1974 | Kaplan et al. | 313/330 |
| 3,836,803 | 9/1974 | Dietz et al. | 313/330 |
| 3,836,804 | 9/1974 | Frens et al. | 313/330 |
| 3,973,156 | 8/1976 | Schreiber | 313/330 |

*Primary Examiner*—Saxfield Chatmon, Jr.

*Attorney, Agent, or Firm*—Hill, Van Santen, Steadman, Chiara & Simpson

[57] ABSTRACT

In order to reduce stresses which occur during radiation production because of the heating-up of the anode, radial bores are formed in the main body member of the anode which extend under the focus path region. Thus, smooth solder surfaces free from recesses can be obtained for receiving auxiliary material such as graphite for increased heat storage and radiation capability. The disclosed rotating anode is particularly suited for x-ray tubes utilized in medical diagnostics.

6 Claims, 4 Drawing Figures

ROTATING ANODE FOR X-RAY TUBES

BACKGROUND OF THE INVENTION

This invention relates to rotating anodes for x-ray tubes where provision is made for relief of thermal stresses. Such tubes are known from U.S. Pat. No. 3,836,803.

In rotating anode x-ray tubes, as is known, the surface of the anode which provides the focus path is locally strongly heated when said surface is impinged by electrons in the production of x-rays. Said surface is thus subject to thermal expansion and causes stresses which can lead to the breakage of the anode. As it is obvious from the aforementioned U.S. Pat. No. 3,836,803, a rotating anode with several radial cuts became known for relieving thermal stress. Thermal stresses are to become smaller due to the subdivision of the anode into smaller parts so as to facilitate an adjustment towards one another.

Another problem in such anodes is the removal of heat. The heat capacity, on one hand, and the radiating capability can both be increased, as is known from British Pat. No. 1,300,477, by attaching parts of graphite to surfaces of the anode lying outside of the focus path. For soldering-on of such parts of graphite it is, however, disadvantageous that the solder can penetrate the thermal stress relieving cuts of the known anode. The disadvantage from this can be realized particularly since the stress-release effect of the cuts is counteracted to a large extent by the penetration of solder. Moreover, solder cannot withstand the thermal load produced by the electron beam, because the melting point of solder compounds is considerably lower than that of the anode material.

The application of cuts, after the graphite parts are mounted, has been proven difficult. It depends on the form of the graphite, the solder and the cleaning of the finished plate. When applying the cuts, in particular to graphite, loose particles are produced at the edges of the cuts. Such loose particles are hard to remove and can interfere with the function of the x-ray tube, as do all loose particles in electron tubes, as is known.

Finally, the known embodiments with thermal stress relieving cuts have the additional grave disadvantage that their stability is lowered. This is of particular importance when the anode is rotated at a high revolution rate. The resulting centrifugal forces can cause the parts, separated by the cuts, to rupture.

SUMMARY OF THE INVENTION

The invention has as an underlying objective the improvement of the stability of a rotating anode for x-ray tubes where such anode is to be subdivided for the purpose of relieving thermal stresses, even with high rotation rates, and to simultaneously simplify the possibility for soldering parts to the anode which increase the heat storing and radiating capability thereof. This objective is inventively resolved by the provision of stress relieving bores as defined in patent claim 1.

Inventively disposed bores leading radially underneath the focus path region from the edges of the anode toward the anode center, show a weak point when the anode is thermally stressed, and by means of such weak points, stresses can be compensated for. This can (but need not) result in the formation of a fine stress-relieving crack or fissure, which can run toward the center; but any such fine crack can be permitted by limiting the radial extent and/or the depth thereof (relative to the thickness of the anode plate). The formation of cracks and their penetration into the anode can only be expected from the upper side through to the bore, because the thermal expansion proceeds only at that point. This is also a reason that the break limit in inventive anode plates in regard to rotation frequency lies considerably higher than is known rotating anodes with stress-relieving cuts.

A crack of controlled extent in accordance with the invention is very narrow in comparison to cuts produced pursuant to the known stress-relieving procedure. Since such a very narrow crack only partially penetrates the plate, i.e. only through to the bore, no electron beam can penetrate ("shoot through") the anode plate when the x-ray tube is in operation, i.e. when the anode is standing still. Moreover, no slits are to be present in the components which store and radiate heat when they are soldered on the anode, and there are no slots in the receiving surface into which solder could rise. Rather, one can proceed from a smooth surface for receiving a disc to be soldered on (which disc may be of e.g. graphite).

In order to obtain a sufficient relief of thermal stress in the anode plate, it is per se sufficient—as in the disposition of recesses—if three bores are provided with at least approximately even spacings. However, the number of bores can also be increased so that the anode plate, for example, can exhibit up to ten or more bores. However, too much a reduction of the mass and thus of the heat conductivity should be avoided as in the known embodiment. In one preferred embodiment, bores which extend under the focus paths are to terminate at the end of each bore toward the center of the anode plate at the surface which is enclosed by the focus paths. Thus, a continuation of the crack through to the center, on one hand, and through the depth dimension, on the other hand, is prevented by the bore itself when relaxation cracks occur. That a crack is formed at the surface only is guaranteed in that—by means of the bore and the expansion occuring at the surface during heating—such surface is prescribed for the course of a crack and the notch stresses occurring with cracks are reduced by means of the bore so that a continuation of the crack is prevented.

Additional details and advantages are subsequently explained with the aid of exemplary embodiments illustrated on the accompanying sheet of drawings; and other objects, features and advantages will be apparent from this detailed disclosure and from the appended claims.

DETAILED DESCRIPTION

Figure 1:
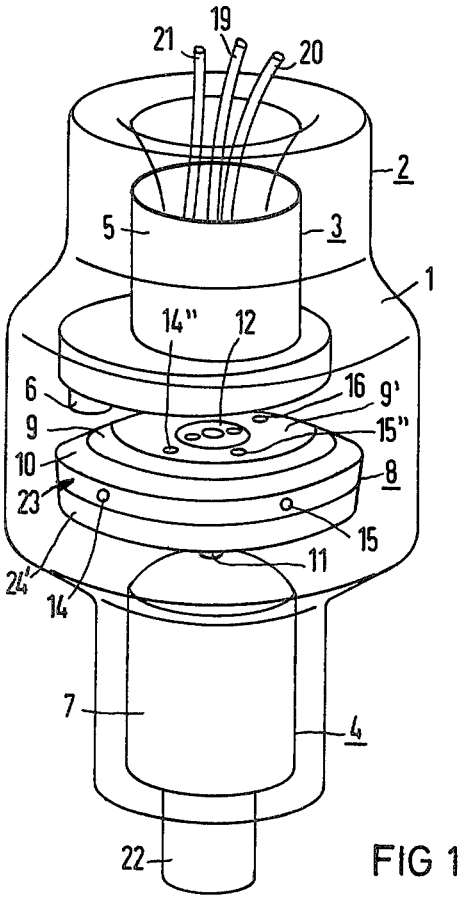
FIG. 1 shows an illustration of an x-ray tube with an inventively designed rotating anode in perspective.

In FIG. 1, 1 references a generally cylindrical glass tube which envelopes the components of an x-ray tube 2. A cathode assembly 3 and an anode assembly 4 are arranged at respective ends of glass envelope 1 in a known manner. Cathode assembly 3 comprises a support 5 with screening 6 in which the hot cathode, concealed in the figure, is accommodated. Anode assembly 4 comprises a rotor 7, and an anode 8 having a diameter of 100 mm. Focus paths 9 and 10 are situated on anode 8 in the manner familiar for anode plates. Anode 8 is mounted on a shaft 11 with the aid of a fastener 12 and a threaded portion 12' at the end of the shaft, the anode being pressed against a shoulder 11' (FIG. 2).

Figure 2:
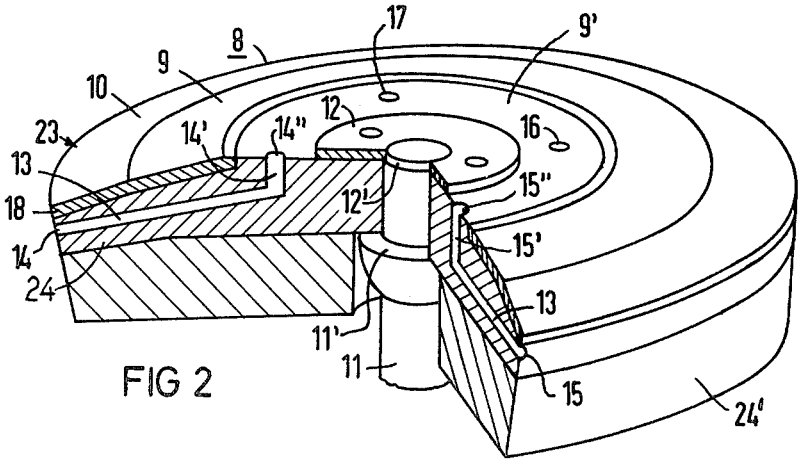
FIG. 2 shows on an enlarged scale the rotating anode used in the tube according to FIG. 1, wherefrom a quarter section is cut in order to demonstrate the bores.

The main body member 24, FIG. 2, of anode plate 23, having a thickness at its outer edge of six millimeters (6 mm) and consisting of molybdenum, is coated at the focus paths 9 and 10 with a 1.5 mm thick layer 18 consisting of rhenium-tungsten alloy. Bores 13 are provided in order to increase the thermal elasticity, mainly the terminal openings such as 14 and 15 of bores 13 being visible in FIG. 1. The openings 14 and 15 are situated at the outer edge of plate 23, while openings 14'', 15'', 16 and 17 are situated at an interior region 9'. The bores 13 are provided in the main body member 24 of plate 23. As seen in FIG. 2 for the case of the bores 13 extending from the openings 14, 15 in plate 23, all of the bores 13 extend primarily generally parallel to the surface of the main body member 24 on which the focus path material 18 is situated. Each bore 13 has a diameter of two millimeters (2 mm) and is located such that less mass of member 24 remains towards the focus side than towards the opposite side, approximately at a ratio of 1:2. As soon as each bore reaches central region 9' which is enclosed by focus path 9, it is terminated and a generally axially extending connecting bore such as 14' and 15' is formed extending from the upper focus side to the associated bore 13. Thus, an arrangement is obtained in which a cracking of member 24 in the area of bore 13 toward focus paths 9 and 10 and toward shaft 11 is terminated by generally axial bores such as 14', 15', FIG. 2, because there, also, the notch stresses are removed.

The necessary operating and heating voltages are applied to the tube via lines 19, 20 and 21 and to anode socket 22—as is known—in order to produce the radiation. The segments of the material of member 24 between the bores 13 can move toward one another with the occurring heating process and the expansion connected therewith and can, as described in the specification, contribute to the release of thermal stresses. Moreover, a member 24' consisting of graphite can readily be soldered to the underside of the anode body member 24 of anode plate 23, as illustrated in FIGS. 1 and 2.

Figure 3:
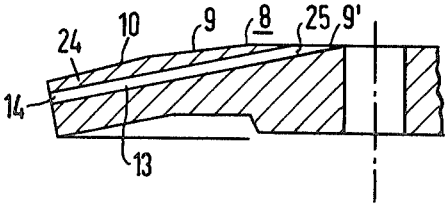
FIG. 3 shows half the cross section of a different embodiment of the bores.

In the segment of anode body member 24 illustrated in FIG. 3, only one of the four bores 13 can be seen. Each bore is conveyed such that it extends from exterior opening 14 to an opening 25 in the central part 9' of body member 24 of anode plate 23. By means of the oblique guiding, the use of axial connecting bores (such as 14', 15' in FIG. 2) is avoided, so that each bore is entirely straight and can be formed in a single step. That is, an additional bore from the focus side of the anode body member (such as bores 14' and 15' in FIG. 2) need not be formed.

Figure 4:
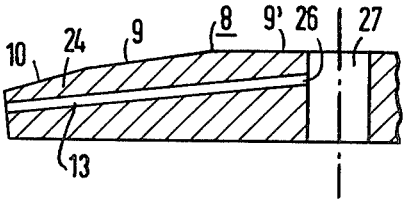
FIG. 4 shows a further embodiment of bore configuration by means of a half cross section view.

In the embodiment according to FIG. 4, each bore 13 is placed into anode body member 24 of anode plate 23 such that it opens at an opening 26 in the central bore 27 for receiving the shaft 11. Thereby a bent-off (non-straight) bore as in FIG. 2 is also avoided.

It will be apparent that many modifications and variations may be effected without departing from the scope of the novel concepts and teachings of the present invention.

I claim as my invention:

1. An x-ray tube rotating anode comprising an actual anode plate (23), said actual anode plate (23) comprising a main body member (24) having an upper side carrying an annular focus path region (9, 10) thereon, and having an underside opposite said upper side and integral with said main body member (24), said actual anode plate having radial bores (13) extending radially in said main body member (24) under said annular focus path region (9, 10) and said bores (13) having cross sectional dimensions less than the thickness of the main body member (24) at the outer perimeter thereof, and said bores (13) being entirely clear of said underside of said main body member (24).

2. A rotating anode according to claim 1, characterized in that the bores begin at the outer edge of the main body member and end at an interior region which is enclosed by the focus path region.

3. A rotating anode according to claim 1, characterized in that the bores emerge at the surface of the main body member at a region thereof which is enclosed by the focus path region.

4. A rotating anode according to claim 2, characterized in that the interior end of each of the bores lies in the main body member and extends generally axially to the surface at the focus side of the main body member.

5. An anode according to claim 1, characterized in that a graphite member (24') is soldered to said underside of the main body member, the upper side carrying the focus path regions being integral with said underside.

6. An anode according to claim 5, with the central radially extending axis of each radial bore (13) being substantially closer to the upper side of said main body member than to said underside thereof at the outer perimeter of said main body member (24).

* * * * *